United States Patent [19]

Tsuchiya

[11] Patent Number: 4,809,917

[45] Date of Patent: Mar. 7, 1989

[54] AUTOMATIC WIRE REPLACING SYSTEM FOR USE IN AN AUTOMATIC WIRE COILING APPARATUS

[75] Inventor: Minoru Tsuchiya, Tokyo, Japan

[73] Assignee: Taga Manufacturing Co., Ltd., Tokyo, Japan

[21] Appl. No.: 135,225

[22] Filed: Dec. 21, 1987

[51] Int. Cl.[4] ..... H01F 41/06

[52] U.S. Cl. ..... 242/7.06; 29/605; 242/7.18

[58] Field of Search ..... 242/7.17, 7.18, 7.15, 242/7.01; 29/605, 596

[56] References Cited

U.S. PATENT DOCUMENTS 3,648,506 3/1972 Caltagirone ..... 29/605

4,320,876 3/1982 Parham, Jr. ..... 242/7.17

FOREIGN PATENT DOCUMENTS 63-62213 3/1988 Japan .

*Primary Examiner*—Stanley N. Gilreath

*Assistant Examiner*—Katherine Matecki

*Attorney, Agent, or Firm*—Cushman, Darby & Cushman

[57] ABSTRACT

Disclosed is an automatic wire replacing system for use in an automatic wire coiling apparatus including spindle having bobbins, at least one group of nozzle members, and a moving/controlling mechanism. The system comprises chucking means equipped on the moving/controlling mechanism so as to chuck a nozzle bar, a nozzle carrier so disposed as to travel in a manner that it can move toward and away from the chucking means, a plurality of clipping bases so disposed that two or more of them are arranged in parallel on each side of a travelling path for the nozzle carrier, and an extending retracting means for extending a corresponding one of the clipping bases onto the nozzle carrier and retracting it from the nozzle carrier.

1 Claim, 9 Drawing Sheets

AUTOMATIC WIRE REPLACING SYSTEM FOR USE IN AN AUTOMATIC WIRE COILING APPARATUS

BACKGROUND OF THE INVENTION

1. Field of the Invention

This invention relates to an automatic wire coiling apparatus which is adapted to permit a wire to be wound around a bobbin to form a coil as an item of electronic parts and, more particularly, to an automatic wire replacing system for use therein which is capable of automatically replacing a wire now in use by another wire differring from it in respect of the type such as, for example, a wire diameter.

2. Description of the Prior Art

Generally, in an automatic wire coiling apparatus, when the type of a coil being formed is changed, the wire having theretofore been in use is in some cases required to be replaced by another wire differring therefrom in respect of, for example, the diameter. In the prior art, in such a case, workman must replace a drum wound with the wire and draw out a new type of wire from another drum thus newly replaced and guide it up to a nozzle via tensioners, guide rollers, etc. so as to introduce it into the nozzle, through manual operations each time such a necessity arises. In addition, according to the wire diameter, the nozzle must also be replaced by another one which is in conformity with the required wire diameter. Accordingly, the prior art automatic wire coiling apparatus raises problems in that when the necessity has arisen of changing the type of a wire, the wire replacing operations therefor are very troublesome and, in additon, the amount of time required therefor is large.

SUMMARY OF THE INVENTION

The present invention has been accomplished under the above-mentioned existing circumstances and the object thereof is to provide an automatic wire replacing system for use in an automatic wire coiling apparatus, which is capable of automatically effecting a simple and easy replacing of the wire type without troubling the workmen involved.

To attain the above object, according to the present invention, there is provided an automatic wire replacing system for use in an automatic wire coiling apparatus including spindles having a plurality of bobbins removably mounted thereon on a rotatable basis, at least one group of nozzle members each adapted to permit its wire to be delivered to its corresponding bobbin, and a moving/controlling mechanism adapted to move a nozzle bar mounted with the one group of nozzle members, in the back-and-forth, right-and-left, and up-and-down directions, the system comprising chucking means equipped on the moving/controlling mechanism so as to chuck the nozzle bar, a nozzle carrier so disposed as to travel in a manner that it can come near to and go away from the chucking means, a plurality of clipping bases each having placed thereon the nozzle bar mounted with the one group of nozzle members each having the wire introduced therethrough, the clipping bases being so disposed that two or more of them are arranged in parallel on each side of a travelling path for the nozzle carrier, and an extracting/retracting means for extracting a corresponding one of the clipping bases onto the nozzle carrier and retracting it from the nozzle carrier.

According to the present invention, when the type of a wire is changed, the nozzle bar on which the group of nozzle members having the wire to be replaced are placed is initially released from the chucking means equipped on the moving/controlling mechanism. Then, it is retracted by way of the nozzle carrier and then is conveyed by the extracting/retracting means up to a specified waiting position. Thereafter, another clipping base having placed thereon the nozzle bar mounted with the group of nozzle members, into which the wire to be next used, is placed on the nozzle carrier by the extracting/retracting means. The new clipping base then is conveyed up to the moving/controlling mechanism by the nozzle carrier. The nozzle bar on this clipping base which is mounted with the group of nozzle members is then mounted on the moving/controlling mechanism by the chucking means.

BRIEF DESCRIPTION OF THE DRAWINGS

An automatic wire replacing system for use in an automatic wire coiling apparatus according to an embodiment of the present invention is illustrated in the drawings in which.

DESCRIPTION OF THE PREFERRED EMBODIMENT

An automatic wire replacing system for use in an automatic wire coiling apparatus in accordance with an embodiment of the present invention will be described below with reference to the drawings.

Figure 1:
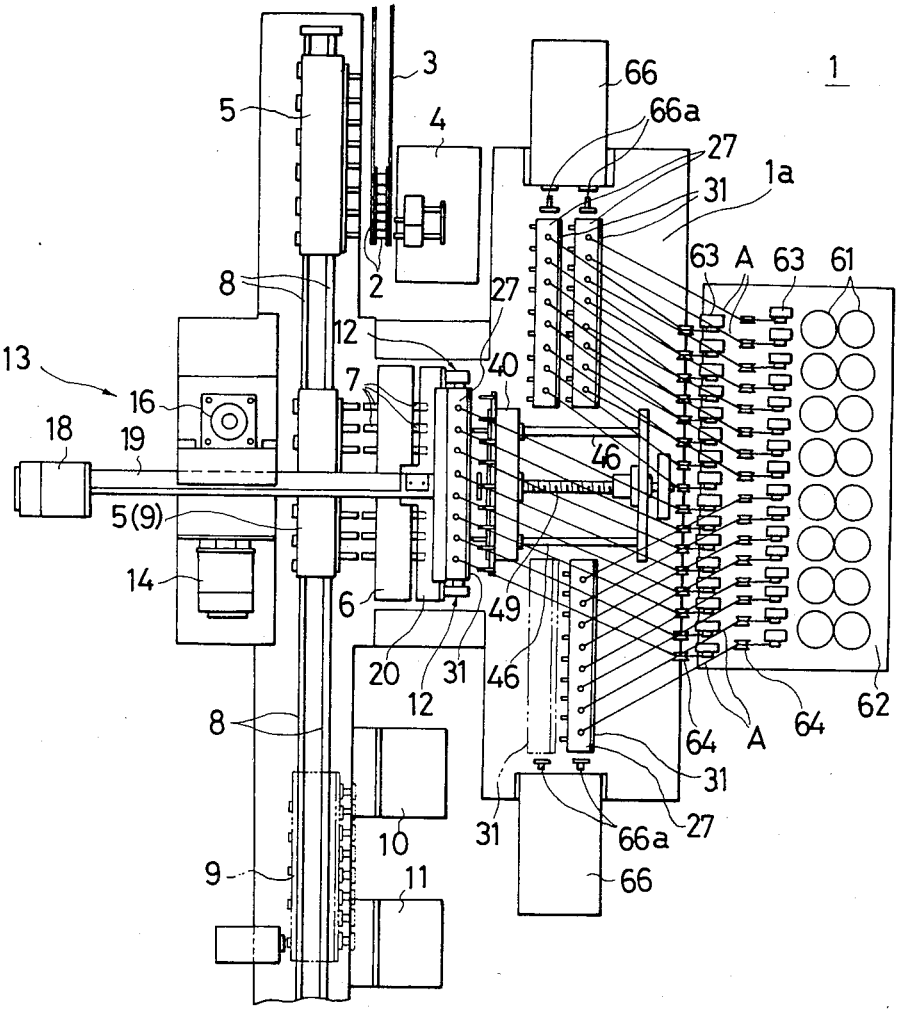
FIG. 1 is a plan view of the automatic wire coiling apparatus which is equipped with an automatic wire replacing system.
Figure 2:
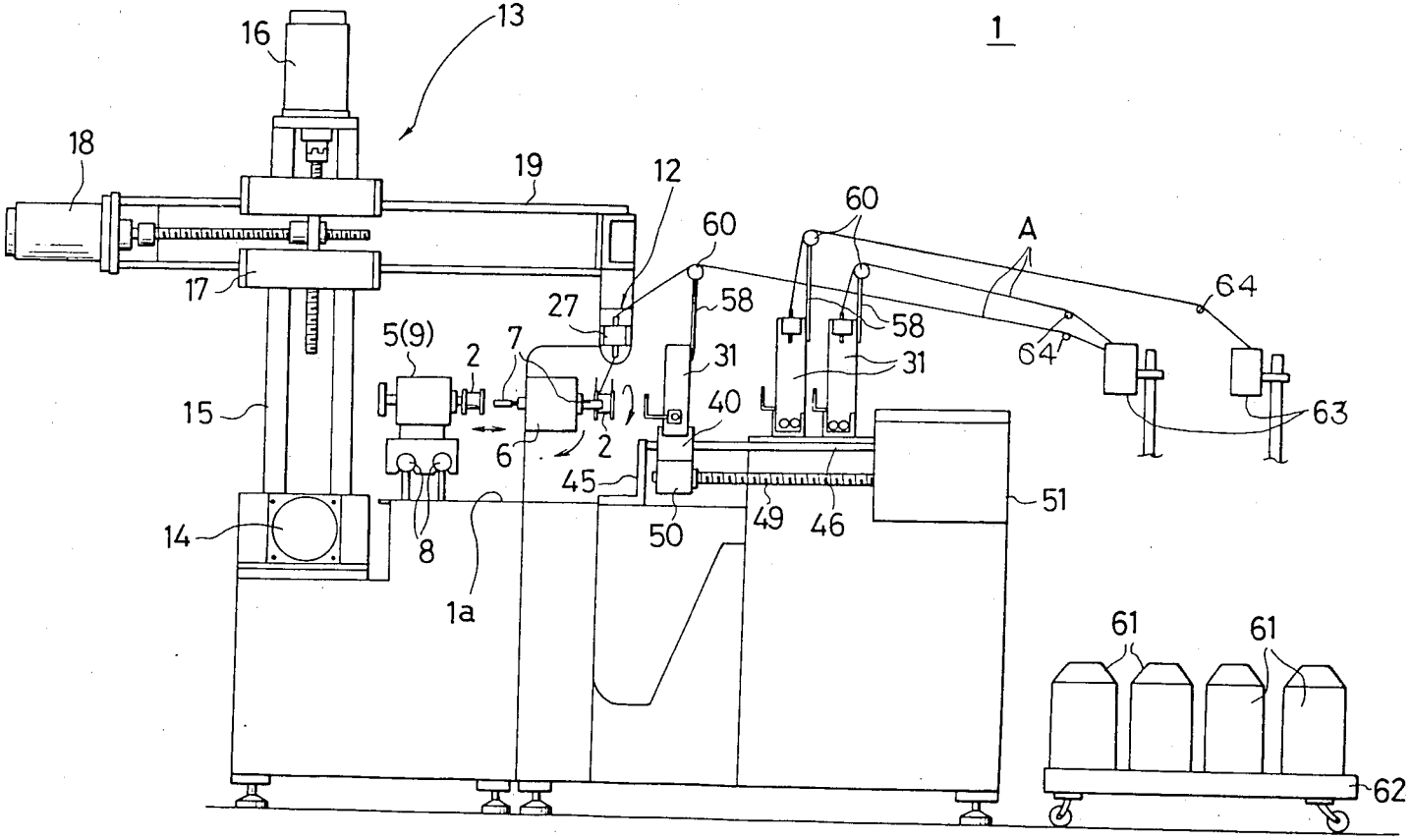
FIG. 2 is a side view of the automatic wire coiling apparatus illustrated in FIG. 1.
Figure 3:
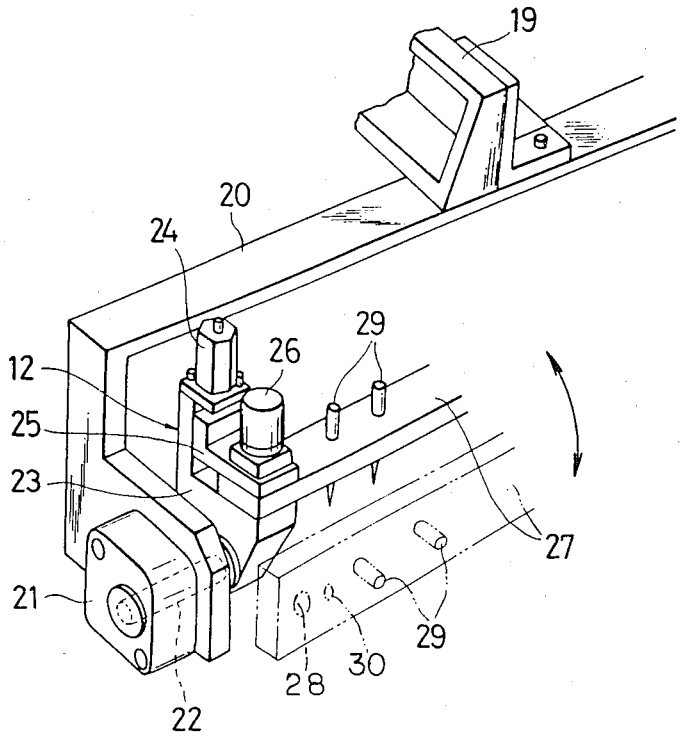
FIG. 3 is a perspective view of essential portions of chucking means.
Figure 4:
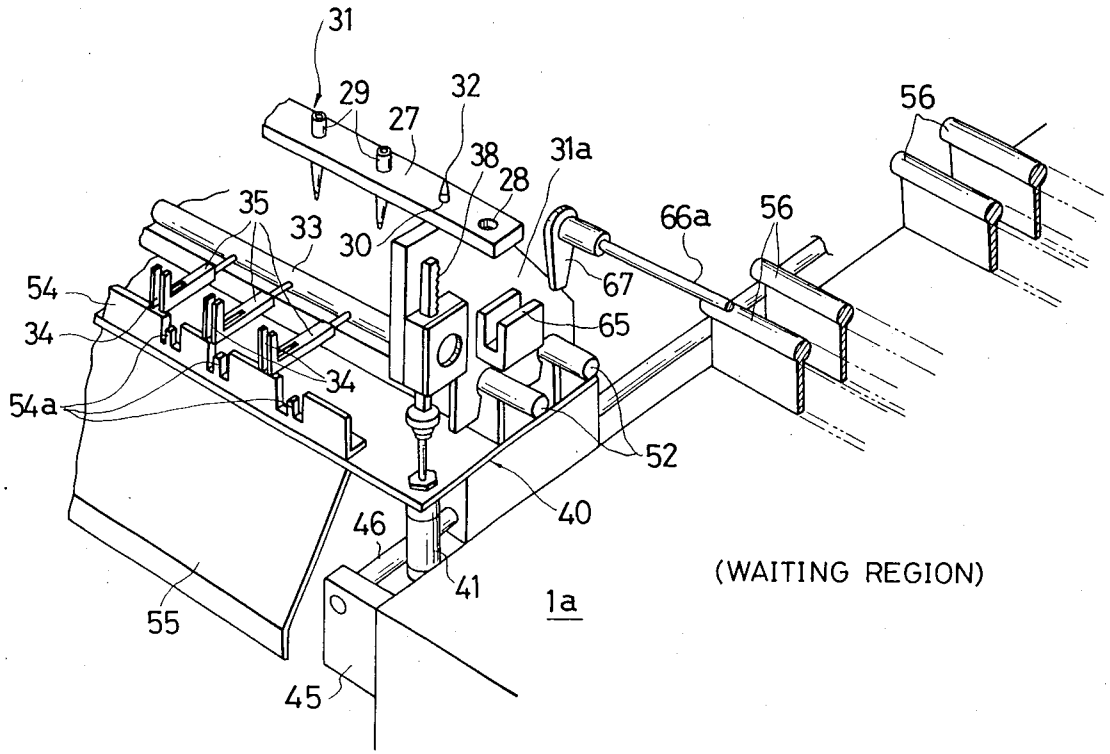
FIG. 4 is a perspective view of essential portions of a nozzle carrier and a clipping base.
Figure 5:
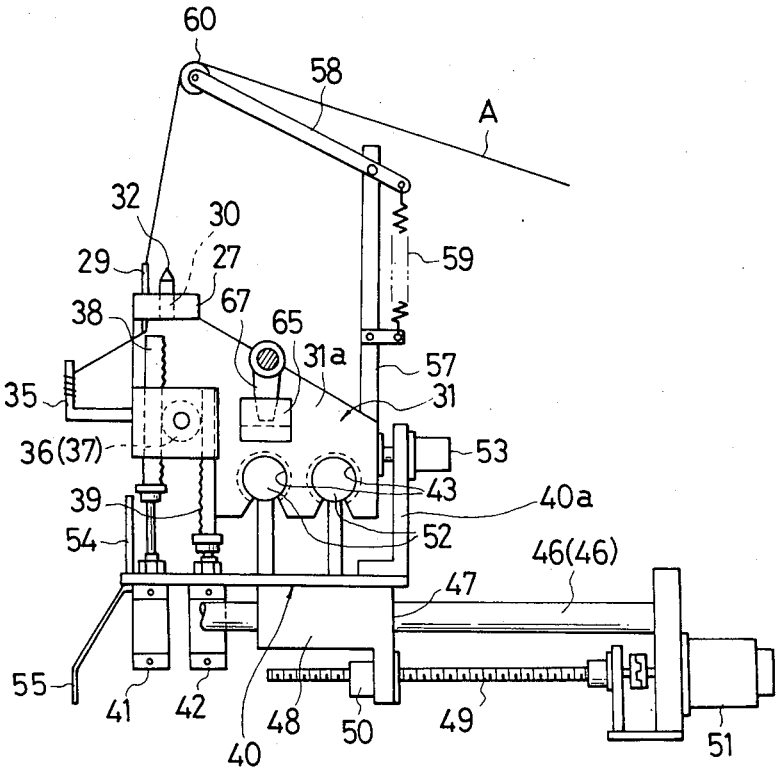
FIG. 5 is a side view of the nozzle carrier and clipping base illustrated in FIG. 4.
Figure 6:
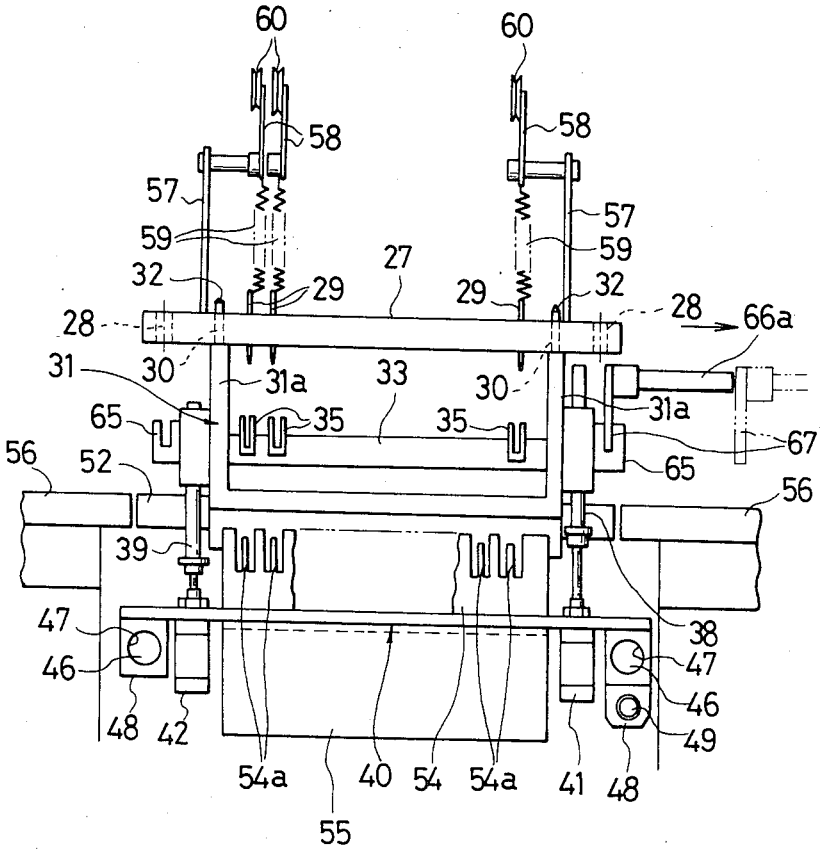
FIG. 6 is a front view of the nozzle carrier and clipping base illustrated in FIG. 4.
Figure 7:
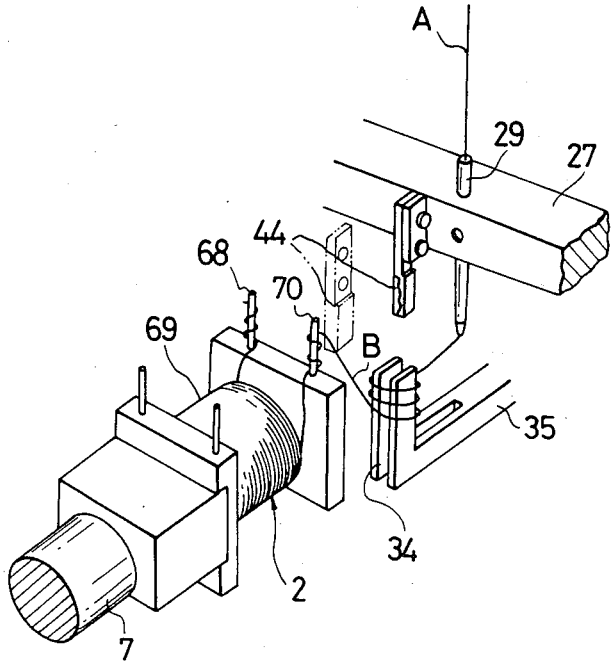
FIG. 7 is a perspective view of respective essential portions of a nozzle bar and a for-disposal winding supporter, illustrating the operational relationship between the two.
Figure 8:
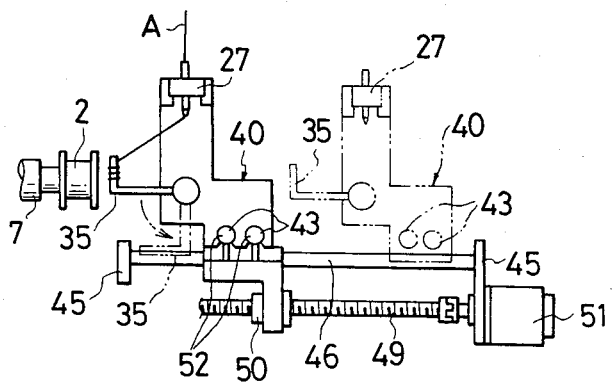
FIG. 8 is a side view of the nozzle carrier, illustrating a state of travel of the same.
Figure 9:
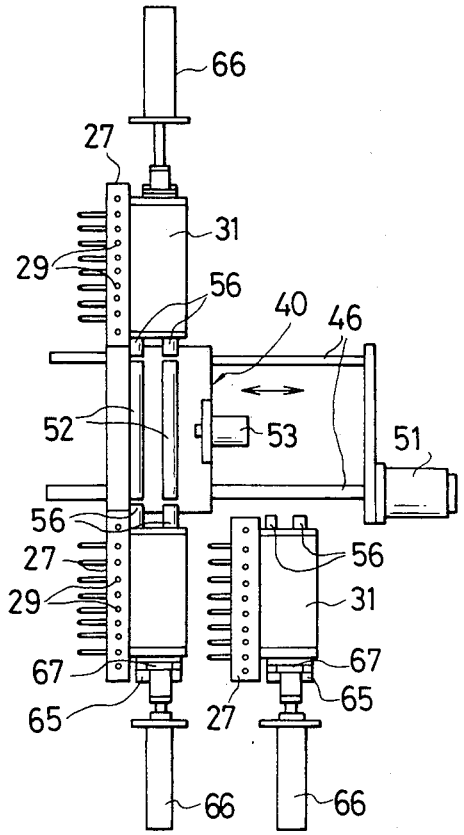
FIG. 9 is a plan view of the clipping bases, illustrating a state of waiting of the same.

Referring now to FIG. 1, a numeral 1 denotes an automatic wire coiling apparatus, in which there is disposed a terminal end of a conveyance means for conveying bobbins 2, 2, - - - in a state wherein they are arranged in one row. The terminal end of the conveyance means 3 is equipped with an automatic bobbin inserter 4 which is so arranged that the bobbins 2 can be inserted, two at a time, over their corresponding shafts on a supply carriage 5. The supply carriage 5 is so arranged that the bobbins 2 may be loaded, at one time, onto their corresponding spindles 7, 7 - - - of a spindle box 6 as later described in the number equal to that of the same, and that it may be caused to travel on rails 8 by being driven by a motor. More specifically, the supply carriage 5 is arranged such that: after a specified number of bobbins 2, 2, - - - have been handed, as mentioned above, to the carriage 5 by means of the automatic bobbin inserter 4, the carriage 5 is caused to travel on the rails 8 up to a position corresponding to the spindle box 6; the bobbins, 2, 2, - - - then are handed to and mounted on their corresponding spindles 7, 7, - - - of the spindle box 6 by operation of air cylinders; and thereafter the carriage 5 is returned back to the position corresponding to the automatic bobbin inserter 4 so as to be mounted with the next series of bobbins. The spindle box 6 is so installed on the automatic wire coiling apparatus that it may be allowed to rotate 180° about its imaginary longitudinal axis. It is provided, at each 180° rotated position thereof, with a row of spindles 7, 7, - - - equal in number to the bobbins 2, 2, - - - in one row of the supply carriage 5. That is to say, when the bobbins 2, 2, - - - mounted on the spindles 7, 7, - - - on the illustrated right side of the spindle box 6 are being coiled with wires, the spindles 7, 7, - - - at the positions rotated 180° therefrom are permitted to hand their coiled bobbins 2, 2, - - - to a conveyance carriage 9, or to receive the next series of bobbins 2, 2, - - - from the supply carriage 5. The spindles 7, 7, - - - are driven, by a motor, to rotate so aa to permit a wire coiling of their corresponding bobbins. The conveyance carriage 9, after having automatically received the coiled bobbins 2, 2, - - - by operation of the air cylinders, is caused to travel away on the pair of rails 8 up to taping devices 10, 11 at which the coils are subjected to taping in various forms, and then is caused to travel away to convey the coils up to a subsequent processing device, an unqualified-product determining device, etc. As shown in FIGS. 1 and 2, a chucking means 12 is disposed at a side of the spindle box 6 opposite to that at which the rails 8 are located. It is fixedly mounted on a tip end of an arm 19 of the moving/controlling mechanism 13. The moving/controlling mechanism 13 is composed of a first movable base 15 which is adapted to move on a table 1*a* by a first pulse motor 14 in a Z direction (the illustrated up and down direction in FIG. 1), a second movable base 17 which is disposed on the first movable base 15 and which is adapted to move by a second pulse motor 16 in a Y direction (the illustrated vertical or up-and-down direction in FIG. 2), and the above-mentioned arm 19 which is disposed on the second movable base 17 and which is adapted to move by a third pulse motor 18 in an X direction (the illustrated back-and-forth direction). For this reason, the arm 19 can freely be moved, by the first to third pulse motors 14, 16, 18, in any of the back-and-forth, right-and-left, and up-and-down directions. The chucking means 12 is constructed as shown in FIG. 3. Namely, a base plate member, or substrate, 20 is secured onto the arm 19, the substrate 20 having side walls at its ends, on which there are fixedly mounted rotary actuators 21, 21 made reciprocatingly rotatable 90° respectively. The rotary actuators 21, 21 have rotating shafts 22, 22 to which there are secured fixing members 23, 23 on which air cylinders 24, 24 are provided. The air cylinders 24, 24 have piston rods, on which there are provided movable members 25, 25 which operate so as to clamp a nozzle bar as later described in cooperation with the fixing members 23, 23. The movable members 25, 25 are provided with locking air cylinders 26, 26 the piston rods of which are adapted to be fitted into locking holes 28, 28 of the nozzle bar 27 shown in FIG. 4. The nozzle bar 27 is equipped with a plurality of nozzle members 29, 29, - - - at specified intervals as shown in FIGS. 4 and 6. More specifically, the nozzle members 29, 29, - - - are equipped on the nozzle bar 27 by the number which is equal to that of the bobbins 2 capable of being loaded on the supply carriage 5, and at the specified intervals each substantially equal to that at which two adjacent of the bobbins 2, 2, - - - on the supply carriage 5 are loaded, said specified intervals, in other words, being substantially equal to that between two adjacent of the spindles 7, 7, - - - . The nozzle bar 27 is formed, at its ends, with pin holes 30 while, on the other hand, pins 32 being fitted into those pin holes 30 are planted in the upper ends of upright walls 31*a* extending at both ends of a clipping base 31. Between the upright walls 31*a* there is rotatably supported an inversion rod 33, on which there are fixedly mounted a plurality of for-disposal winding supporters 35, 35, - - - each shaped like L and formed, at its tip end, with a slit-like groove 34. The for-disposal winding supporters 35 are provided so that two adjacent of them may be located at both sides of a position corresponding to each nozzle member 29. Therefore, the total number of the for-disposal winding supporters 35, 35, - - - is larger by one unit than that of the nozzle members 29, 29, - - - so that any one of the two for-disposal winding supporters 35, 35 located at both sides of the latter 29 may be optionally utilized in connection with the same 29. A raising pinion 36 is equipped on one end of the inversion rod 33, on the other end of which there is equipped a lowering pinion 37. Further, the raising pinion 36 is meshed with a raising rack 38 while the lowering pinion 37 is meshed with a lowering rack 39. Respective lower ends of the raising rack 38 and lowering rack 39 are freely permitted to abut against respective piston rods of a raising air cylinder 41 and lowering air cylinder 42 equipped on a nozzle carrier 40, respectively. Between the inversion rod 33 and the upright walls 31*a* there are provided click mechanism so that the inversion rod 33 may be prevented from being unexpectedly rotated. The click mechanism is of a known construction wherein either one of the inversion rod 33 and the upright wall 31*a* has a ball elastically urged by means of a spring and the other has a bore adapted to receive the ball. The clipping base 31 is formed with a pair of rail reception grooves 43, 43. As shown in FIG. 7, the nozzle bar 27 has a cutter for cutting or breaking a wire portion B which is spanned between a terminal 70 and the for-disposal winding supporter 35. On the upright walls 31*a* of the clipping base 31 there are erected supporting columns 57, 57, between which there are swingably pivoted a series of back tension arms 58, 58, - - - which are equal in number to the nozzle members 29 on the nozzle bar 27, each back tension arm 58, 58, - - - being mounted thereon with a return spring 59. The back tension arm 58, 58, - - - is provided, at its tip end, with a bearing roller 60 so that the wire A may be drawn from a corresponding drum 61 via the bearing roller 60 into the corresponding nozzle member 29. Further, a horizontally-thrown U-shaped engaging piece 65 is provided on one surface of each upright wall 31*a*.

Figure 10:
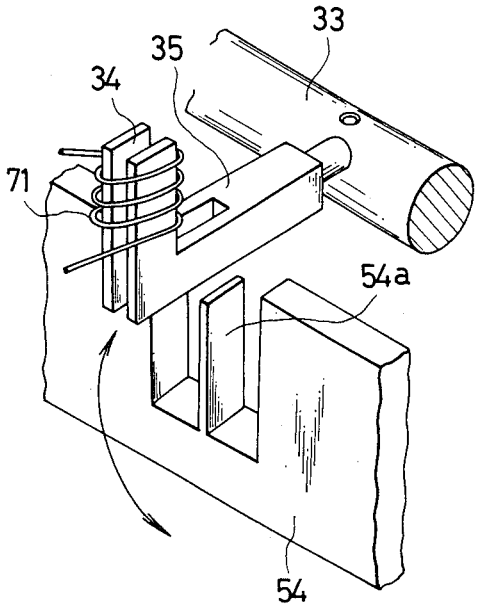
FIG. 10 is a perspective view of respective essential portions of the for-disposal winding supporter and a waste wire removing plate, illustrating the operational relationship between the two.

The automatic wire coiling apparatus 1 has a nozzle carrier 40, which is adapted to convey the nozzle bar 27 on the clipping base 31 from a waiting position thereof to the position corresponding to the chucking means 12. As shown in FIGS. 1, 5, 8 and 9, the nozzle carrier 40 is provided, at its underside, with receiving bores 47, into which there are slidably fitted a pair of guide rods 46, 46, the paired guide rods being each supported between corresponding supporting blocks 45, 45 provided on the surface of a table 1*a*. The receiving bores 47 are formed in receiving blocks 48 which are secured to the underside of the nozzle carrier 40. The nozzle carrier 40 is also provided with an internally threaded block 50, into which a precision male screw 49 is fitted by screwing. The precision male screw 49 is driven to rotate by a pulse motor 51. With respect to the nozzle carrier 40, there are installed a pair of rails 52, 52 which are freely fittable into the rail reception grooves 43, 43 and which are made perpendicular to the direction of travel of the nozzle carrier 40. A locking air cylinder 53 is provided on a rear wall 40*a* of the nozzle carrier 40. The above-mentioned raising air cylinder 41 and the lowering air cylinder 42 also are provided with respect to the nozzle carrier 40. At the front edge of the nozzle carrier 40, there is erected a waste wire removing plate 54 which has comb-like blades 54*a* and into which the above-mentioned for-disposal winding supporters 35, 35, - - - , as shown in FIGS. 4, 6, and 10 are fitted. From the front edge of the nozzle carrier 40 there is substantially suspended a chute 55 intended to permit waste wire portions to fall downwards. Of course, the pulse motor 51 is installed on the surface of the table 1*a*. Respective surface portions of the table 1*a* located on both sides of a region for travel of the nozzle carrier 40 are referred to as "waiting region ". A number of pairs of rails 56, 56 are provided in these waiting regions in a direction perpendicular to the direction of travel of the nozzle carrier 40 so that each pair may be aligned with the pair of rails 52 on the nozzle carrier 40. The function of the rails 56, 56, - - - will now be explained. The clipping base 31 on which the nozzle bar 27 is placed is slided from above the rails 52, 52 to the rails 56, 56 and then the rail reception grooves 43, 43 are fitted onto the rails 56, 56. The clipping base 31 is made to wait at that instant position. With respect to the clipping base 31, 31, - - - kept waiting, a corresponding extracting/retracting means 66 is disposed in a position close to that base. The extracting/retracting means 66 is composed of air cylinders each having a piston rod 66*a*, at the tip end portion of which there is provided a hook 67 which is to be engaged with the engaging piece 65. At the rear portion of the automatic wire coiling apparatus 1 there is disposed a carrier base 62, on which there are placed various wire drums 61, the wire diameter, for example, of which differs from each other. The wire A which has been drawn from its corresponding wire drum 61 is stretched over its corresponding bearing roller 60, 60, - - - by way of its corresponding tensioner 63, 63, - - - and guide roller 64, 64, - - - . These tensioners 63 and guide rollers 64 are disposed on the carrier base 62. The same type of wires are introduced into the nozzle members 29, 29, - - - of each nozzle bar 27, respectively, and then the wire is wound around the for-disposal winding supporter 35 by several turns. It is to be noted that the type of wire A is changed for each nozzle bar 27, 27, - - - .

The operation of changing the type of the wire A to be bound around the bobbin 2 will now be described. The nozzle bar 27 corresponding to the type of the wire, the winding operation of which has been completed, is brought to a position close to the clipping base 31 on the nozzle carrier 40 by means of the moving/controlling mechanism 13. Of course, during the winding operation, the clipping base 31 placed on the nozzle carrier 40 is kept at rest at a specified position close to the nozzle bar 27 chucked by the moving/controlling mechanism 13. The nozzle bar 27 is lowered by the moving/controlling mechanism 13 so as to be placed on the upright walls 31*a*, 31*a*, of the clipping base 31. Thereafter, the piston rod of the air cylinder 26 is released from the engagement with the locking hole 28 of the nozzle bar 27 through operation of the air cylinder 26 shown in FIG. 3 and then the movable member 25 is lifted by operation of the air cyliner 24, whereby the state of chucking of the nozzle bar 27 between the fixing member 23 and the movable member 25 is released. Thus, the pin holes 30, 30 of the nozzle bar 27 are inserted over the pins 32 provided on the upright walls 31*a* of the clipping base 31, whereby the nozzle bar is so positioned that it may be prevented from being disengaged from the latter 31. In this state, the nozzle carrier 40 is moved back, by the pulse motor 51, to a position at which its rails 52, 52 are brought into alignment with those rails 56, 56 in the waiting region which have no clipping base 31. The nozzle carrier 40 thus is stopped at that position. At this time, if a corresponding one of the extracting/retracting means 66 is operated to cause the hook 67 to project, this hook 67 will be brought into engagement with the engaging piece 65 when the nozzle carrier 40 has reached said position. Then, if the extracting/retracting means 66 is operated after the clipping base 31 is unlocked through operation of the locking air cylinder 53, the clipping base 31 having the nozzle bar 27 placed thereon is caused, as the hook 67 is introduced into the engaging piece 65 for engagement therewith, to slide from the rails 52, 52 on the nozzle carrier 40 onto the rails 56, 56 laid in the waiting region. Thus, the clipping base 31 is caused to travel up to a specified position in the waiting region, at which it waits until it is used for the next winding operation. Further, through the operation of the pulse motor 51, the nozzle carrier 40 is moved up to the position of the clipping base 31 having the nozzle bar 27, the nozzle members 29 of which are inserted therethrough with the type of wires required to be used for the next winding operation. If, thereafter, the extracting/retracting means 66 is operated to cause the hook 67 to project, the corresponding next clipping base 31 is extruded because of the hook 67 being in engagement with the engaging piece 65, whereby it is caused to slide from the rails 56, 56 in the waiting region onto the rails 52, 52 on the nozzle carrier 40. Thereafter, the clipping base 31 is urged by means of the locking air cylinder 53 and thus is fixed to the rails 52, 52. At this time, the raising air cylinder 41 and the lowering air cylinder 42 are located below the raising rack 38 and the lowering rack 39, respectively, so that the two air cylinders 41, 42 may be allowed to push the two racks 38, 39, respectively. After the clipping base 31 has been fixed, the nozzle carrier 40 is caused, by the driving of the pulse motor 51, to travel up to a specified position close to the chucking means 12 while it is guided by the guide rods 46. The moving/controlling mechanism 13 is so operated as to control the position of the nozzle carrier 40 to permit the nozzle bar 27 to enter the interspaces between the fixing members 23 and the movable members 25 kept in the condition of having been spaced away from the former members 23. Further, the air cylinder 24 is operated to cause both end portions of the nozzle bar 27 to be clamped between the fixing members 23 and the movable members 25. Further, the air cylinders 26 are operated to cause their piston rods to be fitted into the locking holes 28 of the nozzle bar 27, thereby positioning the nozzle bar 27. Thereafter, the nozzle bar 27 is caused to perform its winding operation. In case of the bobbin 2 having such a configuration as shown in FIG. 7, the winding operation is carried out as follows. First of all, the nozzle 29 is caused, by the moving/controlling mechanism 13, to make its circular movement around a terminal piece 68, so that the wire A is wound about the terminal piece 68 by a specified number of turns. Thereafter, the nozzle bar 27 is moved by the moving/controlling mechanism 13 to cause a cutter 44 to break the wire portion between the terminal piece 68 and the for-disposal winding supporter 35. Thereafter, the bobbin 2 integral with the terminal piece 68 is caused to rotate by means of the spindle 7 while, on the other hand, the nozzle member 29 is reciprocatingly moved by the moving/controlling mechanism 13 in the axial direction of the bobbin 2. Whereby, the wire A is wound around a barrel portion 69 of the bobbin 2. At this time, the lowering air cylinder 42 is operated to upwardly move the lowering rack 39, to thereby cause the lowering pinion intermeshed with the latter 39 to rotate. As a result, the inversion rod 33 is rotated, as shown in FIG. 10, by the lowering pinion 37 against the engaging force of the click mechanism, to lower the for-disposal winding supporter 35 wound with the waste wire 71. Thus, the slit-like groove of the winding supporter 35 is inserted over the comb-like blade **54*a* of the waste-wire removing plate 54. As a result, the waste wire 71 is removed from the winding supporter 35. After removal of the waste wire 71, the raising air cylinder 41 is operated to upwardly move the raising rack 38, to thereby cause the raising pinion 36 intermeshed with the latter 38 to rotate. As a result, the inversion rod 33 is reversely rotated, Thus, the for-disposal winding supporter 35 is restored to its original position. On the other hand, after completion of winding the wire A around the barrel portion 69 of the bobbin 2, the nozzle member 29 is caused, by the moving/controlling mechansim 13, to make its circular movement around the other terminal piece 70, so that the wire A is wound around the terminal piece 70. Subsequently, the nozzle member 29 is caused, by the moving/controlling mechanism 13, to make its circular movement around the for-disposal winding supporter 35 to permit the wire A to be wound around the winding supporter 35 by several turns. Further, the nozzle bar 27 is moved by the moving/controlling mechanism 13 to cause the cutter 44 to cut off a wire portion B between the terminal piece 70 and the winding supporter 35. Thus, preparation is made for the next winding operation. Where the bobbin 2 is of the type wherein the terminal pieces 68 and 70 horizontally project sidewise from the side plates of the bobbin 2, a rotary actuator 21 shown in FIG. 3 is operated to cause the nozzle bar 27 to rotate through an angle of 90° and, in this state, the wire A is wound around each terminal piece 68, 70** in the same manner as mentioned above. Thereafter, the foregoing operation is repeatedly carried out each time the type of the wire A is changed.

The respective waiting positions of each nozzle bar 27 and the clipping base 31 are set in advance. The bearing rollers 60 of the clipping base are made to differ from each other in respect of their height. This is for the purpose of, when the clipping base 31 having the nozzle bar 27 placed thereon is replaced by another clipping base 31, preventing the wire A of the former clipping base 31 from being entangled with the wire A passed through the nozzle bar 27 of the latter clipping base. Each back tension arm 58, 58, - - - is allowed to make its swinging operation in accordance with a change in tension of the wire A when the clipping base 31 is caused to travel by the nozzle carrier 40, thus absorbing the change in tension of the wire A.

As has been described above, according to the automatic wire replacing system for use in an automatic wire coiling apparatus in accordance with the present invention, when the type of the wire to be coiled is changed during the operation of the apparatus, it is possible to automatically replace the wire now in use by another required one without use of such workmen's labours as in the prior art. Thus, the present invention offers a good deal of advantage when in use.

What is claimed is:

1. An automatic wire replacing system for use in an automatic wire coiling apparatus including spindles having a plurality of bobbins removably and rotatably mounted thereon a plurality of wires to be delivered to the bobbins, at least one group of nozzles, each nozzle having one of said wires introduced therethrough to deliver the wire it its corresponding bobbin, at least one nozzle bar on which one of said groups of nozzles is mounted, and a moving/controlling mechanism for moving one of rail bars, in back-and-forth, right-and-left, and up-and-down directions, the system comprising chucking means provided on said moving/controlling mechanism so as to chuck said nozzle bar, a nozzle carrier, means for moving the nozzle carrier near to and away from said chucking means, a plurality of clipping bases each having placed thereon one of the nozzle bars said clipping bases being arranged in a parallel in a waiting region on each side of a travelling path for said nozzle carrier, and an extending/retracting means for extending a corresponding one of said clipping bases onto said nozzle carrier and retracting it from said nozzle carrier.

* * * * *